United States Patent [19]

Ahlf et al.

[11] Patent Number: 4,851,019

[45] Date of Patent: Jul. 25, 1989

[54] ELECTRIC VACUUM CLEANER

[75] Inventors: Heinz-Jürgen Ahlf, Bergisch-Gladbach; Jürgen Jäger, Witten; Peter Wulf, Ennepetal; Wieland Gühne, Remscheid; Manfred Eckart, Wuppertal, all of Fed. Rep. of Germany

[73] Assignee: Vorwerk & Co. Interholding GmbH, Wuppertal, Fed. Rep. of Germany

[21] Appl. No.: 187,435

[22] Filed: Apr. 28, 1988

[30] Foreign Application Priority Data

May 4, 1987 [DE] Fed. Rep. of Germany ..... 3714780
Sep. 12, 1987 [DE] Fed. Rep. of Germany ... 3712390[U]

[51] Int. Cl.[4] ..... B01D 46/00

[52] U.S. Cl. ..... 55/367; 55/373; 55/375; 55/381; 55/473; 55/472; 15/350; 15/352

[58] Field of Search ..... 55/362, 367, 373–378, 55/381, 471–473; 15/327 D, 327 E, 350, 352

[56] References Cited

U.S. PATENT DOCUMENTS 2,360,155 10/1944 Nuffer et al. ..... 15/327 D
4,262,384 4/1981 Bowers ..... 15/328
4,670,937 6/1987 Sumeran ..... 15/352

FOREIGN PATENT DOCUMENTS 0044501 1/1982 European Pat. Off. .
3217240 11/1982 Fed. Rep. of Germany .
571339 11/1976 Switzerland .
2049855 12/1980 United Kingdom .
2108377 5/1983 United Kingdom ..... 15/350

*Primary Examiner*—Bernard Nozick
*Attorney, Agent, or Firm*—Martin A. Farber

[57] ABSTRACT

An electric vacuum cleaner having a chamber arranged above the motor housing to receive a filter bag the side of which facing the motor housing is in valve-closed socket-connection communication with the fan-air channel and which can be removed from the chamber after opening and separating the socket connection. The filter bag is in socket-connection communication with a filter-bag intermediate support which is carried along upon the swinging open of the chamber and which has the valve-closure member and from which the filter bag can be separated somewhat on the other side of the vertical position of the cross-sectional plane of the socket connection.

22 Claims, 10 Drawing Sheets

T
E
E
K
19
22
21
27
23
14
17
20
32
33
39
18
12
31
6'
7
24
40
30
29
12
14
5
8
8'
26
5
1

T
30
29
12
14
5
33
18
12
31
6'
39
32
7
20
12
17
18
14
E
E
T
K
21
42
27
23
19'
22
19
V
T
40
24
19''
R
41
8'
26
5
1
8
32
33

ELECTRIC VACUUM CLEANER

FIELD AND BACKGROUND OF THE INVENTION

The present invention relates to an electric vacuum cleaner having a chamber arranged above the motor housing to receive a filter bag the side of which facing the motor housing is in valve-closed socket-connection communication with the fan-air channel and which can be removed from the chamber after opening and separating the socket-connection communication.

The changing of the filter bag, or more precisely, the removal of the full filter bag presupposes a certain amount of skill in many cases. This is ture, in particular, in the case of those types of electric vacuum cleaners in which the filter bag is arranged upside down with downward directed opening and the motor fan is below it. The user helps himself out by bringing the appliance into the horizontal position. Nevertheless, as a result of a certain aspiration resulting from the gripping of the bag, dust and other particles emerge and dirty, in particular, the region of the connection. Even valve-closure members associated with the filter-bag-opening mouth do not provide a satisfactory remedy with regard to this in all cases.

The object of the invention is to improve the handling of an electric vacuum cleaner of this type in a manner which is easy to manufacture, particularly to the effect that a clean, convenient removal of the full filter bag is assured.

SUMMARY OF THE INVENTION

According to the invention the filter bag (7) is in socket-connection communication with a filter-bag intermediate support (T) which is carried along upon the swinging open of the chamber (6) and which has a valve-closure mamber (K) and from which the filter bag (7) can be separated somewhat on the other side of the vertical position (vertical line E—E) of the cross-sectional plane of the socket connection.

As a result of this development, the handling of the filter bags on vacuum cleaners of this type is substantially facilitated. The emergence of dust or the falling out of larger, heavier particles is practically out of the question, this simply due to an advantageous change in the position of the filter bag. In this connection, the change of the filter bag can even take place in the normal position of use of the electric vacuum cleaner; it need not be placed on its side. Furthermore, in vacuum cleaners of this kind, the proven energy-favorable arrangement can be retained, namely the motor operates from the bottom to the top and the filter bag is filled from the bottom with the dust-laden air. In this connection, the means used are simple and suitable in that one proceeds in the manner that the filter bag is in socket-connection communication with a filter-bag intermediate support which is carried along upon the swinging open of the chamber and which bears the valve-closure member and from which the filter bag can be separated approximately on the other side of the vertical position of the cross-sectional plane of connection. The swinging open which takes place in the plane of separation between the motor housing and the filter-bag chamber not only provides optimum accessibility for the said handling but also favorable prerequisites for the assembling of the vacuum cleaner itself. The filter-bag intermediate support which is carried along acts like a carried/along cover of the socket-connection communication. As soon as the intermediate support reaches the said position the filter bag can be detached. Since only in this position is the mouth of the filter bag exposed, the contents are definitely held back against falling out. It is of particular advantage that the valve-closure member is seated on the intermediate support. The filter bags therefore need no longer be equipped in this respect. The handling is optimized by automatic separation of the socket-connection communication by the stopping of the swinging motion of the intermediate support and further swinging of the chamber socket. If this swinging movement of the chamber socket covers a full useful angle of 180° then the filter bag can be very simply withdrawn in the same way as an insert from the upwardly open chamber, which is then vertical. In an advantageous further development, the socket-connection is to a bottom of the filter bag, the surface shape of which corresponds approximatetly to the cross section of the chamber socket. The latter forms practically a connecting collar for the porous, in particular, textile wall of the filter-bag receiving chamber fastened thereon. The textile wall can be stiffened by a metal basket, a plastic ribbing or the like. If such a stiffening is not present, the corresponding body of the bag can be detachably fastened on the rod of the electric hand vacuum cleaner. With due consideration of the adaptation of the bottom of the filter bag in accordance with the cross section, the corresponding cross section is also fully utilized. A stable, well-defined association of the filter bag furthermore results from the fact that its bottom rests on an edge step on the inner wall of the chamber socket. For this purpose, the wall of the filter bag is set back slightly by the amount corrseponding to the resting surface. The angle of swing of the chamber socket is arranged approximately at the height of the resting surface of the filter-bag bottom. In this connection, intermediate support and chamber socket swing advisedly around a common axis of swing. The stopping of the intermediate support in the said approximately vertical filter-bag release position is advisedly effected by a swing-limiting stop lies adjacent to the common axis of swing. The swinging open is in this case facilitated by a handle on the free end side of the intermediate support. The closed position, on the other hand, is secured in customary manner, for instance by a detent hook lock which can be actuated by a push button. For a structurally simple, spatially small valve-closure device, the invention proposes that the valve-closure member be made of a valve flap on the upper end edge of a socket of the intermediate support which engages into the bottom of the filter bag. A rubber flap or a plastic flap having the corresponding properties can be used here. With suitable toughness of the material of the intermediate support, a development of the same material is conceivable. In order to achieve an easy separation of filter bag and socket, the end edge of the socket furthermore extends downward towards the axis of swing. The socket is advisedly also curved in the radius of swing of the filter-bag intermediate support. With full utilization of the chamber cross section available, the easy removal of the filter bag from the chamber can nevertheless be facilitated in the manner that the bottom of the filter bag forms grip niches. In order, in this connection, in particular to avoid that sections of the bag wall become bulged out by these grip niches or come into a wrinkled constellation in which they would be subjected to increased mechanical stressing, projections of the intermediate support which act to support the wall engage into the grip openings.

Corresponding projections are at the same time an indicator as to whether the filter bag has been inserted correctly and whether it is the proper filter bag. In this connection orientation marks on the periphery of the filter-bag bottom with which there are associated mating features in the region of the inner wall of the chamber socket are furthermore useful. Furthermore, it is advantageous for the filter-bag bottom to rest only on the opposite edges extending transverse to the gripping niches. In this way, there is even obtained a certain bendability of the bottom so that upon the passage in between of any particles the bottom of the filter bag will not be damaged but can move away.

Another advantageous possibility for the swing-dependent uncoupling of the filter-bag chamber from the intermediate support consists therein that the axis of swing of the intermediate support lie eccentrically to the axis of swing of the chamber socket in the manner that a detent engagement present at the start of the swinging motion between the two swing parts is eliminated approximately in the vertical position of the intermediate suport. The corresponding coupling means are developed very simply in the manner that the detent projection for the detent engagement is seated on the free end of the chamber socket and the corresponding detent shoulder is seated on the corresponding face end of the intermediate support. An advantageous trap function can finally be obtained by simple means in the manner that the detent projection is developed as trap nose and is seated on a flexible wall part of the chamber connection. Upon the swinging closed of the filter-bag chamber, the correct coupling position for operation is thus automatically obtained. The wall material itself forms the spring for the trap nose.

BRIEF DESCRIPTION OF THE DRAWINGS

With the above and other objects and advantages in view, the present invention will become more clearly understood in connection with the following detailed description of preferred embodiments, when considered with the accompanying drawings, of which.

DETAILED DESCRIPTION OF THE PREFERRED EMBODIMENTS

Figure 1:
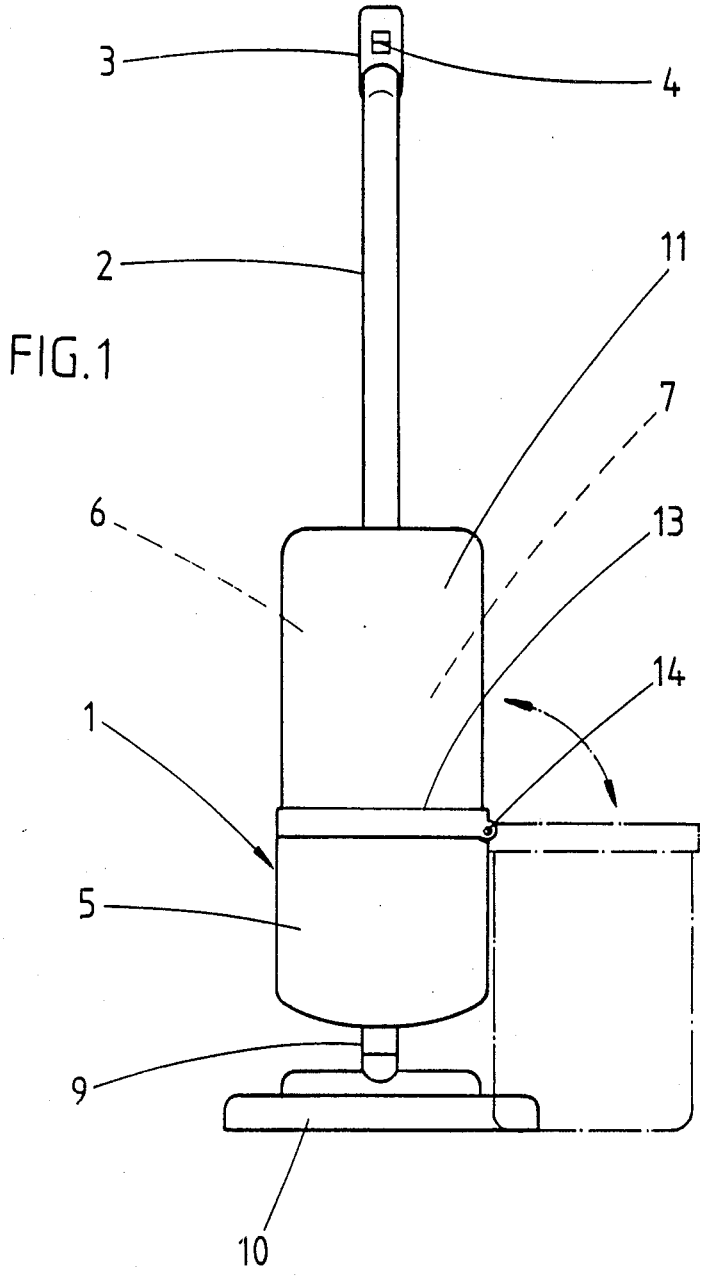
FIG. 1 is a view of the electric vacuum cleaner developed in accordance with the invention with the swung-open position of the chamber containing the filter bag, shown in dot dash line.

The electric vacuum cleaner shown is designed as a hand-held device. It has a housing 1 adjoining which, in upward direction there, is a rod 2 with handle 3 at one end. In the transition region between the handle 3 and the rod 2 there is an on/off switch 4. The connection for the electric cord has not been shown.

The housing 1 is divided into a motor housing 5 and a chamber 6 extending above it to receive a filter bag 7. The motor fan has also not been shown in detail in the drawing.

The side of the filer bag 7 which faces the motor housing 5 is in socket-connection communication with the fan-air channel 8.

The motor housing 5 passes at the bottom into a tube coupling 9 which produces the air-flow connection to a section nozzle 10.

The suction nozzle 10 can be a what is commonly referred to as, a suction/brush roller which is placed in rotation by a separate drive.

The fan motor therefore operates from the bottom to the top and accordingly forces the dust-laden air into the filter bag 7 which is arranged upside down above the motor housing 5.

The cross section of the housing 1 is long and rectangular with slightly arched wide sides and slightly arched narrow sides. In FIG. 1 the vacuum cleaner is shown on the wide side.

The chamber 6 which receives the filter bag 7 which is of corresponding cross section is formed of a textile bag 11 reinforced with a wire of plastic basket and passing at its bottom, i.e. on the motor housing side, into a stiffened rim in the from of a chamber socket 12. The stiffened textile bag 11 can be associated with this chamber socket by means of a detachable clip-plug connection. The region of attachment is stepped down for this purpose. The step can be noted in FIG. 1. It is designated 13 and permits a well-defined inner-outer association of the textile bag. An inner plug arrangement is preferred.

For the removal of the filter bag 7, the housing 1 can be swung open with practically complete exposure of its cross section. The swung-open position can be seen in from FIG. 1 (shown in dot-dash line) and FIGS. 5 and 7. The axis of swing 14 which permits this is located on the one narrow side of the housing 1. Its chamber-socket-side bearing lugs are designated 15. These bearing lugs 15 lie in the transition region between narrow side and wide side of the chamber 6. Between the two bearing lugs there extends a continuous bearing lug of the motor housing 5.

In the region of the joint between the motor housing 5 and the chamber 6 there is furthermore integrated an intermediate support T on which the filter bag sits. The filter-bag intermediate support T has a contour which is adapted to the cross section of the housing but is set back from the outer wall of the housing 1 so that it is substantially completely invisible in the coaxial position of motor housing 5 and chamber 6 shown in FIG. 1. Except for a small place of access, it is surrounded namely by the extended lower rim of the chamber socket 12 of the filter-bag intermediate support T which is also arranged swingably and swings around the same axis of swing 14 as the filter-bag chamber 6. On the hinge side, the intermediate support T therefore, in the same way as the chamber socket 12, also forms two bearing lugs, designated 16.

Figure 3:
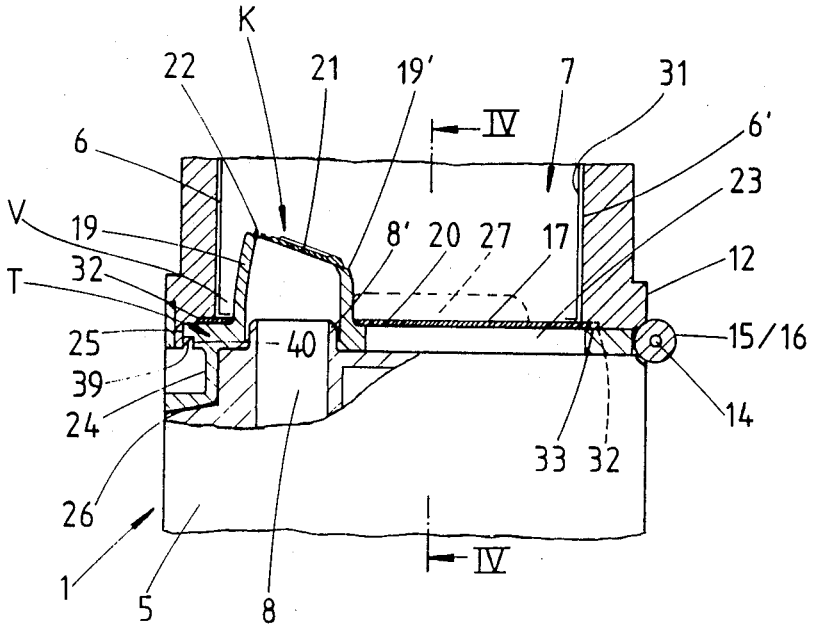
FIG. 3 shows the region of the place of the swinging of the vacuum cleaner, in closed position and in fragmentary view.

The filter bag 7 which directly adjoins the intermediate support T has a bottom 17. Its general contour corresponds also to the cross-sectional shape of the chamber socket 12 which, for supporting application in the region of the narrow sides of the bottom 17 on the inner wall forms respective rim steps 18. In this way the bottom 17 cannot slide into the chamber 6 in the swung-open position of the apparatus. The bridge-like resting of the bottom 17, on the other hand, however, produces a certain bendability of the bottom 17 in the central region. The common axis of swing 14 of chamber socket 12 and filter-bag intermediate support T extends approximately at the height of the resting rim step 18 of the filter-bag bottom 17. In the closed housing 1 (FIG. 3) the rim step 18 extends over the top of the said bottom 17 so that upon the suction blowing it is not pushed off in upward direction. The top side of the bottom 17, as already indicated, rests on the top side of the filter-bag intermediate support T. In this connection a sort of clamping-jaw grasping is obtained between chamber socket 12 and the intermediate support T in the regions of the narrow side of the bottom 17.

In this position the fan-air channel 8 with its offset cylindrical mouthpiece end 8' extends into the lower region of a socket (outlet) 19. The latter protrudes beyond the top of the valve-bag intermediate support T. The socket 19 is developed at the same time on the intermediate support T and extends, passing through an opening (inlet) 20 of corresponding cross section in the filter-bag bottom 17, into the inside of the filter bag 7, closing off the edge.

In order, with the upside-down position of the filter bag shown, to avoid vacuumed material dropping back into the region of the motor housing 5, the socket 19 forms a valve flap 21 at its free end. The valve flap rests with the predominant region of its edge freely on the edge rim of the socket 19. It is fixed merely in the position designated 22 so that it lifts off under the action of the flow of air but, upon the reduction in the corresponding bottom-side load, returns into its closed position. The valve flap 21 can be developed as separate structural part and associated with the place 22 by means of a clip attachment; alternatively, there is of course the possibility of molding it thereon in case of corresponding flexible material of the socket 19 or filter-bag intermediate support T.

The socket 19 tapers down towards its free end so that its introduction into the opening 20 has practically a centering effect.

Figure 2:
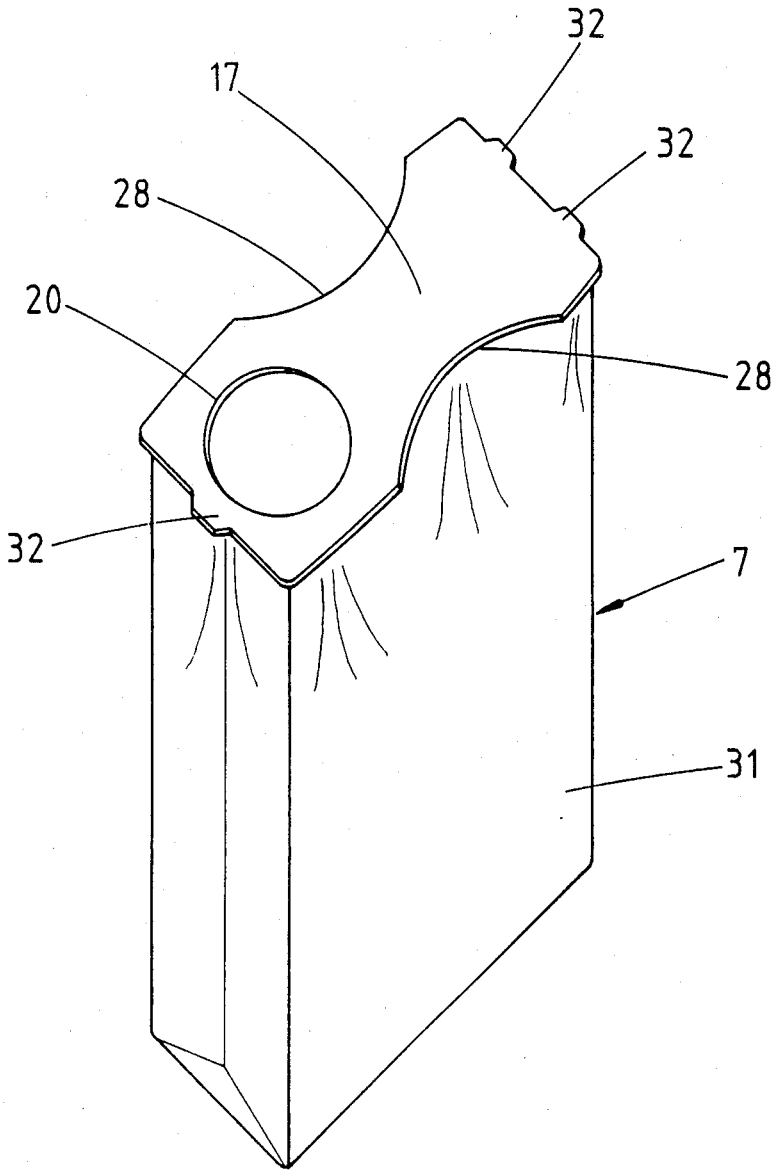
FIG. 2 is a perspective view of the filter bag.
Figure 4:
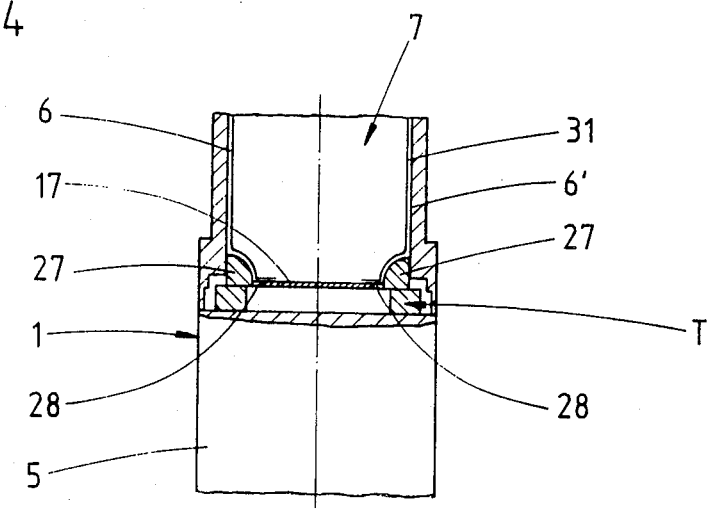
FIG. 4 is a section along the line IV—IV of FIG. 3.

As can be noted from FIG. 2 the end edge 19' of the socket 19 is beveled. It extends downward in the direction of the axis of swing 14. An imaginary line in this direction intersects the axis of swing. The connecting place 22 lies in the upper region of the socket end rim.

The socket 19 advisedly otherwise assumes a radial course of curvature to the axis 14. Between the root region of the socket 19 and the region on the axis-of-swing side the intermediate support T has a window-line opening. This opening bears the reference number 23. The hinge-side frame leg has a greater width than the two frame legs facing the wide side wall of the housing.

At the free end, the intermediate support T forms a freely accessible handle 24 at its end side there. There is concerned here a bottom angular extension of the intermediate support T. The angular extension originates from a region which is set back with respect to the end side 25 there. The corresponding leg extends vertically. The substantially horizontal leg adjoining same extends back to the outer wall of the housing 1 and terminates flush with the latter. In the region of the handle there is seated a hook-detent device (not shown in detail) which is actuatable by push button and secures the closed postion of the housing. In order to receive the handle 24, the corresponding region of the motor housing 5 is cut out in niche-like fashion. The recess bears the reference number 26. Upwardly directed projections 27 also extend from the top side (in the position shown in FIG. 3) in the region of the longer frame legs of the intermediate support. These projections close the grip openings 28 on the longer rim edges of the filter-bag bottom 17. Both grip openings 28 are rounded and are open toward the corresponding inner wall of the chamber socket. In the open position of the housing 1, the wasp-waisted middle region of the bottom can be conveniently grasped by a clamping grip and lifted out of the chamber 6.

Furthermore, the filter-bag intermediate support T is so associated and developed that it has a limited angle of swing, i.e. it cannot come into the 180° angular position of the chamber socket 12; rather, it remains in a position which lies approximately in or on the other side of the vertical position E—E of the socket-connection cross-sectional plane so that the socket-connection communication V lies on the other side of the angular bisector of the maximum angle of swing of 180°. In this position, there is sufficient free space for the filter bag 7 in order to withdraw it from the intermediate support (see FIG. 5). The corresponding position is defined by a limiting stop 29 between the bearing lug of the motor housing 5 and the rear flank 30 lying in the direction of swing of one or both bearing lugs 16 of the filter-bag intermediate support T (see FIG. 6).

Figures 5, 6:
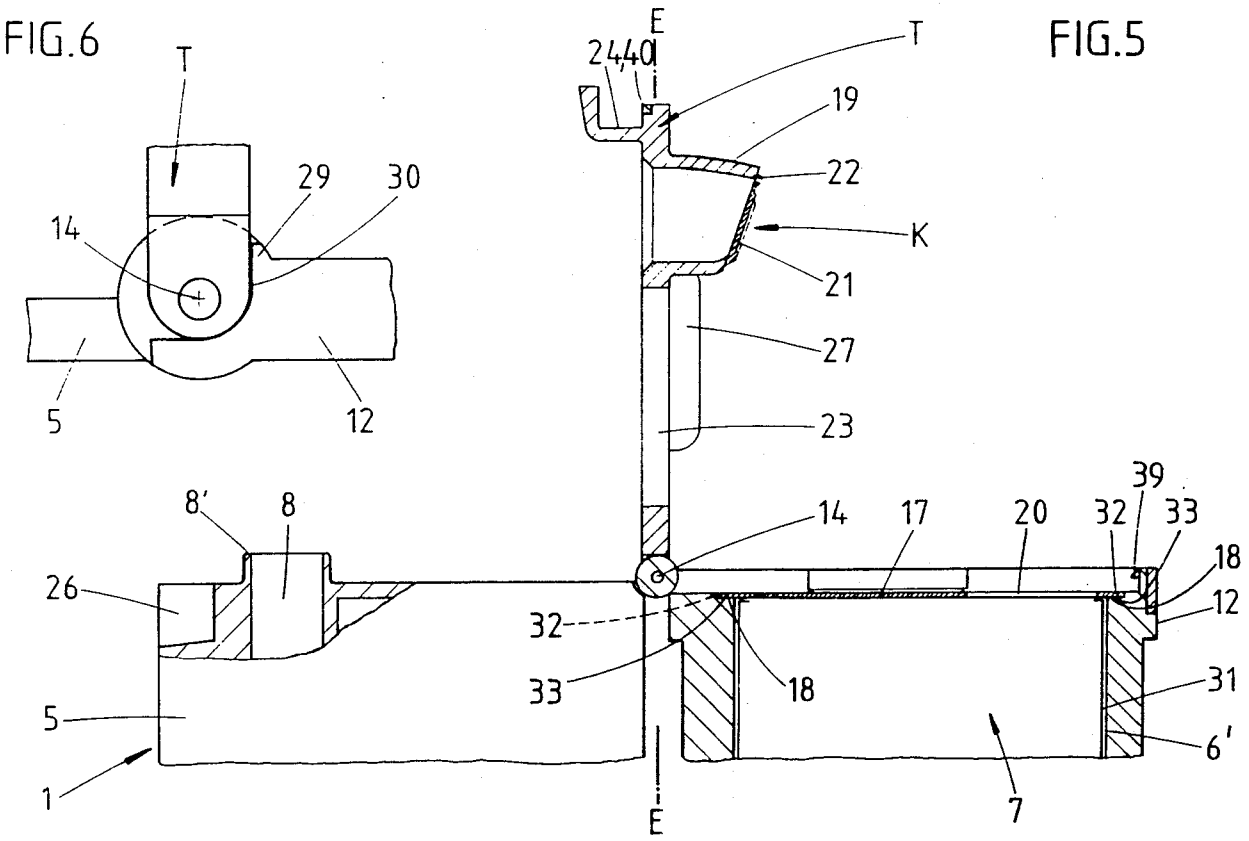
FIG. 5 is a view corresponding to FIG. 3 but in the swung-open position and approximately in the position of the intermediate support stopped in the vertical plane.
FIG. 6 shows the swing-limiting stop which produces this stopping, in an individual enlarged view.

In addition to this type of separation of intermediate support T and filter bag 7, there is also present that of an automatic separating of the socket-connection communication V, namely by the aforementioned stopping of the swinging motion of the intermediate support T and a further swinging of the chamber socket 12 of the chamber 6 into the 180° position shown in FIG. 5. The static friction of the filter-bag wall 31 on the chamber wall 6' in combination with a certain filling pressure namely holds the filter bag 7 frictionally fast in the said chamber. The transition into the position inverse to the upside-down position and therefore with opening 20 pointing upwards takes place without the possibility of an escape of dust or larger particles. The filter bag can therefore be conveniently gripped in the manner explained above and lifted out. The filter-bag wall is not pushed in. It is not necessary to touch the wall upon the removal; all aspiration is absent. By stretching the bag there is obtained, to be sure, a suction effect. The insertion of a new filter bag is readily possible in the same manner since the entire cross section of the chamber 6 is open towards the top (see FIG. 1). Accordingly, it is merely necessary still to swing the chamber 6 back into the position shown in solid line in FIG. 1, in which position the upper structure of the housing 1 which comprises the chamber 6 automatically engages on the motor housing 5. In this return swing path, the opening 20 captures the socket 19 or vice versa. This can take place in the vertical position of the filter-bag intermediate support T which is possibly still present with frictional lock or else, however, only when the back of the intermediate support T again rests on the top of the motor housing 5. In the closed position, the projections 27 substantially fill the grip openings 28, i.e. to such an extent that upon the inflating of the filter bag or else by the fill load no bulging out of the fleece-like paper filter wall 31 can take place.

In order to enlarge the grip openings 28 which are opposite each other, the wall region lying in this direction and therefore pointing outward, of the inner wall of the chamber socket 12 is additionally recessed somewhat. For the foolproof associating of the filter bag 7 in the proper position its bottom 17 is provided in the region of both narrow sides with orientation features 32 which engage in suitable mating features 33 in the region of the inner wall of the chamber socket 12. The orientation features are trapezoidal projections on the narrow side of the flat body which forms the bottom. In this way a correctly aligned position is obtained between opening 20 and socket 19 before an improper association is noticed due to the housing parts coming together in an improper closing position.

Figure 7:
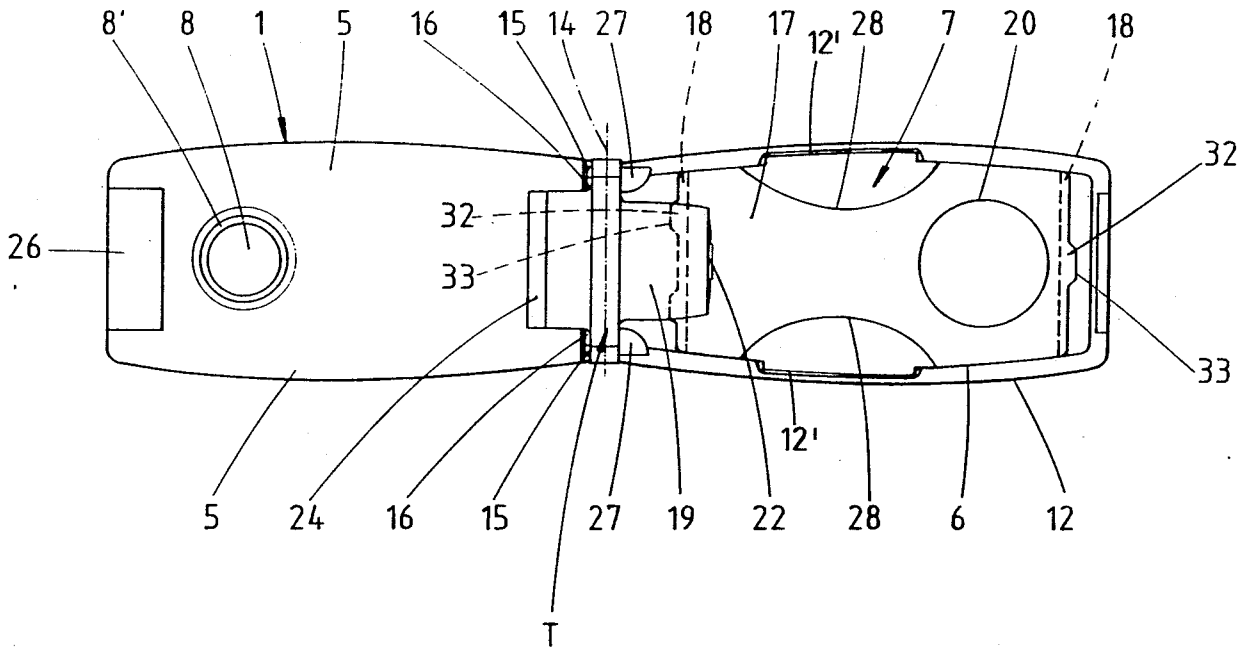
FIG. 7 is a top view of FIG. 5.
Figure 8:
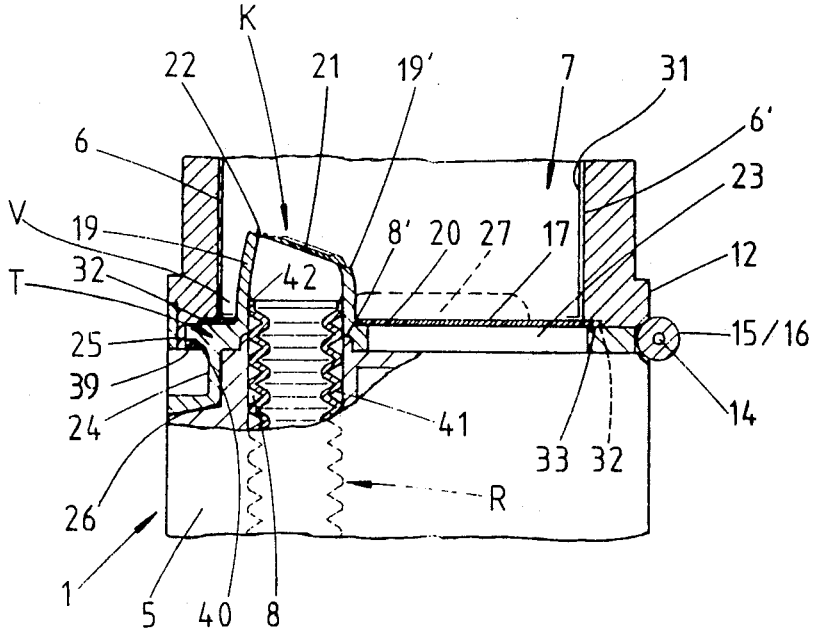
FIG. 8 shows the region of the swinging of the vacuum cleaner in closed position, in fragmentary view, showing a tube connection.
Figures 9, 10:
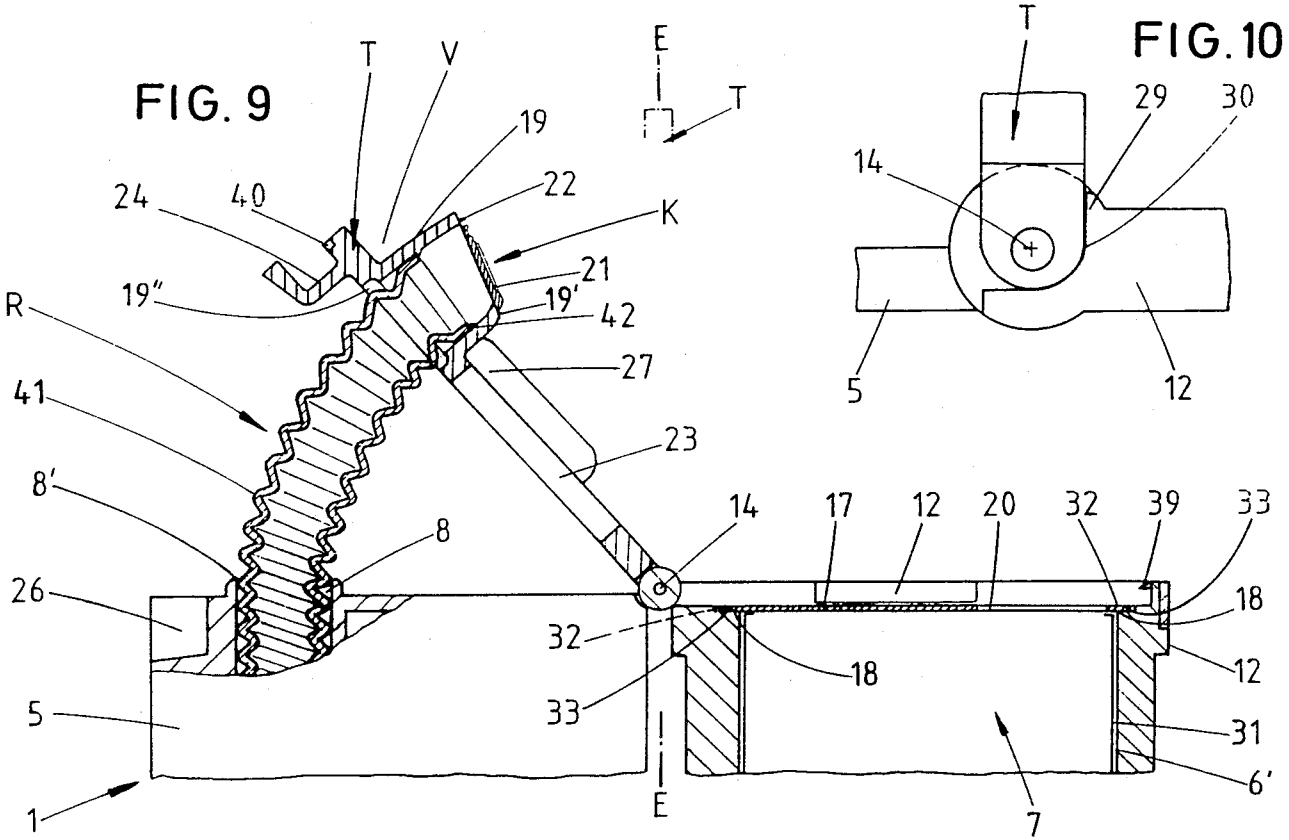
FIG. 9 is a showing corresponding to FIG. 8 in the intermediate position of the intermediate support on the return path, including fan-air tube connection (the stopped position lies in the vertical plane E—E)
FIG. 10 shows the swing-limiting stop which produces this stopping in the vertical plane, in an individual enlargement.
Figure 12:
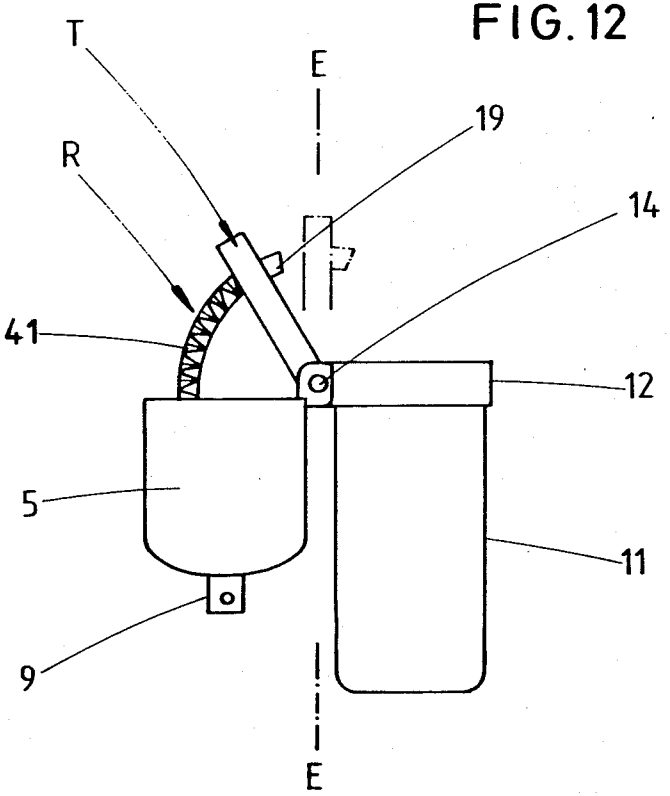
FIG. 12 shows the intermediate and swung-open positions.
Figure 11:
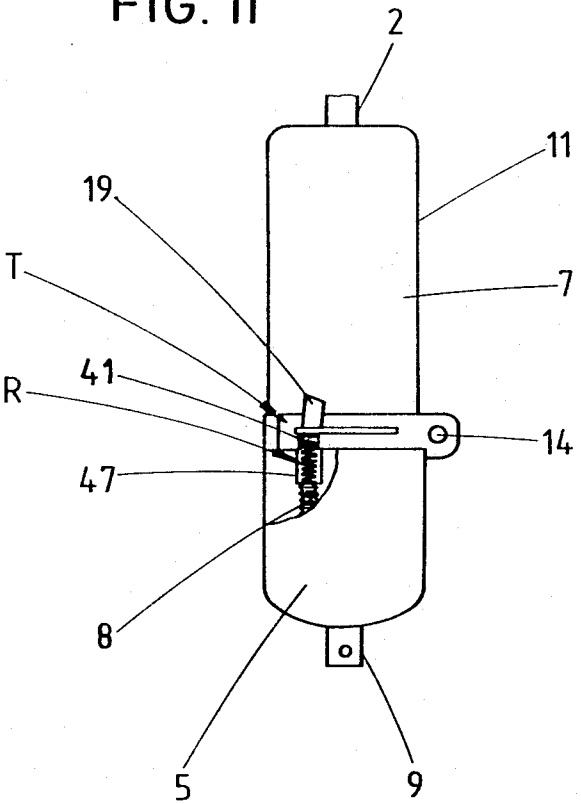
FIG. 11 shows the electric vacuum cleaner in a very diagrammatic manner, showing the principle of the fan-air tube connection in accordance with the first embodiment (accordion hose)
Figure 14:
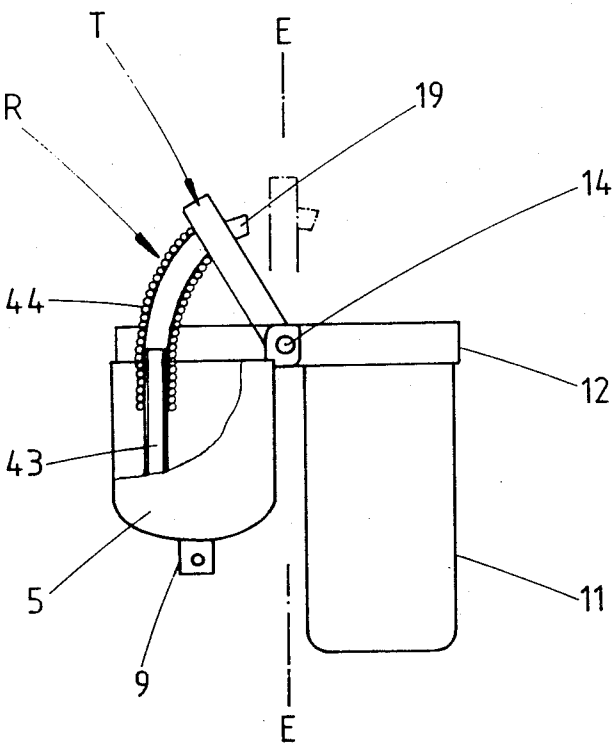
FIG. 14 shows the corresponding intermediate and swung-open positions.
Figure 13:
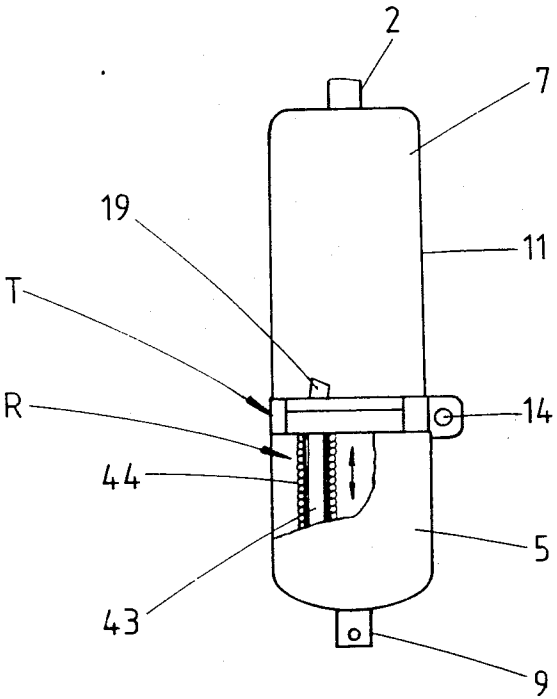
FIG. 13 shows the electric vacuum cleaner, showing a different embodiment of the fan-air tube connection (hose/guide tube)
Figure 16:
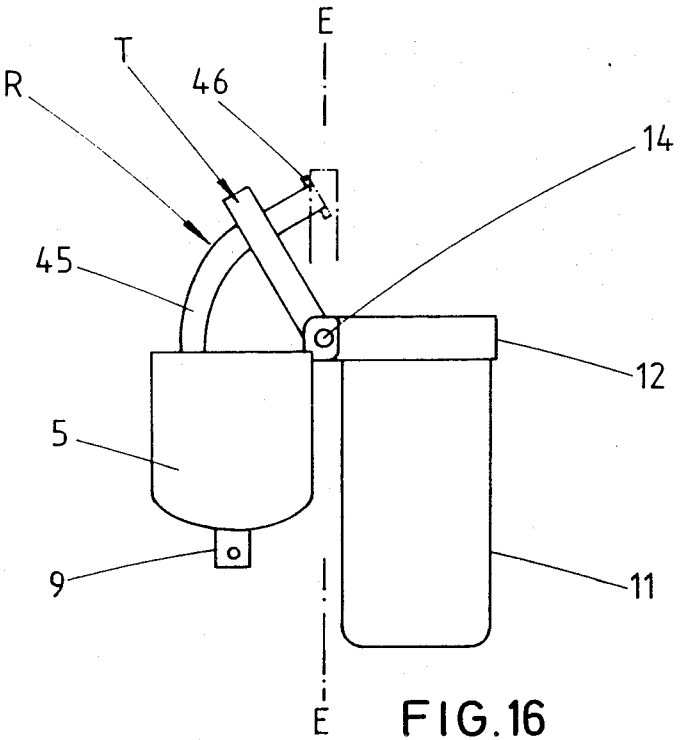
Figure 15:
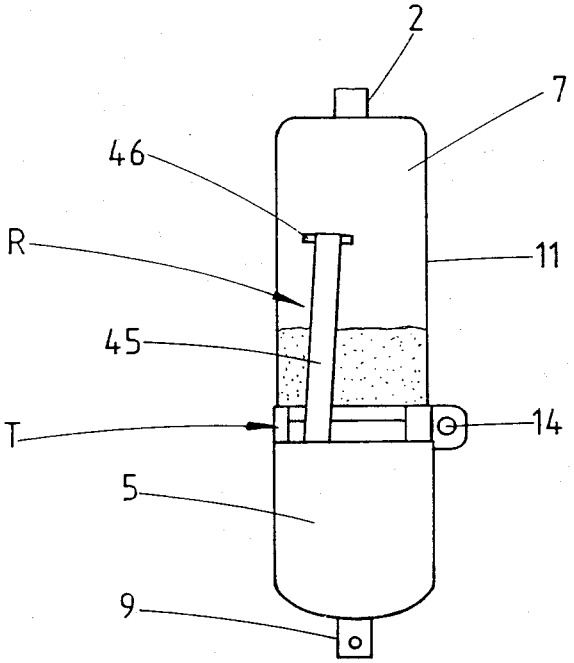
FIG. 15 shows the electric vacuum cleaner with fan-air tube connection in accordance with another embodiment (flexible tube); and Fig, 16 shows the corresponding intermediate and swung-open positions.

The facing lengthwise sides of the projections 27 are transversely rounded, as can be noted from FIG. 7, which also serves for the associating in proper position of the bottom 17. They act as control surfaces on the corresponding rounded niche base of the grip openings 28.

Instead of the stop means shown in FIG. 6, a separation of the intermediate support T from the chamber 6 of the filter bag 7 can be effected alternatively in the manner that the axis of swing of the intermediate support T lies eccentrically to the axis of swing of the chamber socket 12 in such a manner that a detent engagement present at the start of the swing movement between the two swing parts is eliminated approximately in the vertical position of the intermediate support T. The corresponding eccentricity is about 1.5 mm. Referring to FIG. 5, the offset of the axes would be directed upward and therefore extent in the plane E—E. Specifically, the corresponding development is obtained in the manner that the detent projection 39 for the detent engagement is seated on the free end of the chamber socket 12. There is concerned a nose formed on the inner wall of the chamber socket 12. This nose points in the direction of the axis 14. The associated detent shoulder is designated 40. It lies on the corresponding face end of the intermediate support T. With due consideration of the eccentric position of the axis, the intermediate support T which acts like a drag cover moves, for instance, approximately in the vertical position, out of the region of the detent projection 39. On the other hand, the filter-bag chamber can be closed also if the intermediate support T is moved out of the position shown in FIG. 3. In this case there occurs a kind of trap function since the detent projection 39 is, in practice, formed as a trap nose and is seated on a flexible part of the wall of the chamber socket 12. This wall section therefore moves resiliently outward.

We claim:

1. In an electric vacuum cleaner having a chamber arranged above a motor fan to receive a filter bag having one side facing a motor housing and being via an inlet ot the bag in valve-closed connecting communication with a fan-air channel in the motor housing and being removable from the chamber after opening and separating of socket connection communication, the improvement comprising a filter-bag intermediate support having an outlet, and wherein said chamber, said motor housing, and said filter-bag intermediate support therebetween, are pivoted relative to each other, and wherein the filter bag via said inlet and outlet is in socket connection communication with said filter-bag intermediate support which is carried along upon the chamber swinging open, and said filter-bag intermediate support has a valve-closure member, and from which the filter bag can be separated somewhat on another side of a vertical position of a cross-sectional plane of the socket connection.

2. An electric vacuum cleaner according to claim 1, the improvement wherein the chamber forms a chamber socket, and orientation features disposed on the periphery of a bottom of the filter bag which are engageable with mating features in the region of an inner wall of the chamber socket.

3. An electric vacuum cleaner accordifng to claim 1, the improvement further wherein said intermediate support has a free face end on which is located a handle.

4. An electric vacuum cleaner accordifng to claim 1, the improvement further wherein the chamber forms a chamber socket, and said socket connection communication being automatically separated by stopping the swinging movement of the intermediate support and further swinging of the chamber socket.

5. An electric vacuum cleaner according to claim 4, the improvement further wherein the socket connection communication is at a bottom of the filter bag, the surface shape of which corresponds approximately to a cross section of the chamber socket.

6. An electric vacuum cleaner according to claim 5, the improvment further wherein the bottom of the filter bag rests on an edge step on an inner wall of the chamber socket.

7. An electric vacuum cleaner according to claim 5, wherein said chamber socket has an axis of swing which is arranged approximately at the height of a resting surface of the bottom of the filter bag.

8. An electric vacuum cleaner according to claim 1, the improvement further wherein the intermediate support and the chamber swing around a common axis of swing.

9. An electric vacuum cleaner according to claim 8, the improvement further comprising a swing-limiting stop for the intermediate support, adjacent the common axis of swing.

10. An electric vacuum cleaner according to claim 1, wherein the valve-closure member is formed by a valve flap on an uppper end edge of a socket of said intermediate support which engages into said inlet at a bottom of the filter bag, and said socket forms said outlet.

11. An electric vacuum cleaner according to claim 10, the improvement further wherein the end edge of the socket extends downward towards an axis of swing of said intermediate support.

12. An electreic vacuum cleaner according to claim 1, wherein a bottom of the filter bag forms grip niches.

13. An electric vacuum cleaner according to claim 12, the improvement further wherein said intermediate support has projections which engage into the grip openings.

14. An electric vacuum cleaner according to claim 12, the improvement further wherein a bottom of the filter bag rests only on opposite edges which extend transverse to the grip niches.

15. An electric vacuum cleaner according to claim 1, the improvement further wherein an axis of swing of the intermediate support lies eccentric to an axis of swing of the chamber so that a detent engagement, present at the start of the swinging open movement, between said intermediate support and said chamber is eliminated approximately at a vertical position of the intermediate support.

16. An electric vacuum cleaner according to claim 15, the improvement wherein the chamber forms a socket, and a detent projection for the detent engagement is seated on a free end of the chamber socket and a corresponding detent shoulder is seated on a corresponding face end of the intermediate support.

17. An electric vacuum cleaner according to claim 16, wherein the detent projection is formed as a trap nose and is seated on a flexible wall prat of the chamber socket.

18. An electric vacuum cleaner according to claim 1, the improvement further comprising a fan-air connection pointing in the direction of the swinging open movement of the chamber and which extends from the lower side of the filter-bag intermediate support.

19. An electric vacuum cleaner according to claim 18, the improvement further wherein the tube connection is formed by a hose which is pushed over a guide tube.

20. An electric vacuum cleaner according to claim 18, wherein the tube connection is formed by a suitably flexible tube which points in the direction of the swinging open movement of the chamber and which passes through the filter-bag intermediate support into the filter bag.

21. An electric vacuum cleaner according to claim 18, the improvement further wherein the tube connection being formed by an accordion hose.

22. An electric vacuum cleaner according to claim 21, the improvement further comprising a receiving chamber arranged below the filter-bag intermediate support for the collapsed accordion hose.

* * * * *